United States Patent [19]

Kimura

[11] Patent Number: 4,697,172

[45] Date of Patent: Sep. 29, 1987

[54] FIRE ALARM SYSTEM

[75] Inventor: Tetsuo Kimura, Tokyo, Japan

[73] Assignee: Nittan Company, Limited, Japan

[21] Appl. No.: 780,094

[22] Filed: Sep. 25, 1985

[30] Foreign Application Priority Data

Dec. 25, 1984 [JP] Japan ..... 59-272098

[51] Int. Cl.[4] ..... G08B 29/00

[52] U.S. Cl. ..... 340/587; 340/526; 340/529

[58] Field of Search ..... 340/587, 526, 529

[56] References Cited

U.S. PATENT DOCUMENTS 4,195,286 3/1980 Galvin ..... 340/587

4,597,451 7/1986 Moore et al. ..... 340/587

FOREIGN PATENT DOCUMENTS 1558471 1/1980 United Kingdom ..... 340/587

*Primary Examiner*—Glen R. Swann, III

*Attorney, Agent, or Firm*—Stevens, Davis, Miller & Mosher

[57] ABSTRACT

A fire alarm system employing multiple sensors can accurately and quickly respond to real fires with an alarm signal and prevent issuance of a false alarm due to noise or the like. A pair of decision circuits in a fire signal receiver receive fire detection signals from respective sensors and produce fire occurrence signals representing a first level of probability that a fire has occurred and decision signals representing a second lower level of probability that a fire has occurred. A fire alarm is issued when a fire occurrence signal has been outputted by any one of the decision circuits or when a decision signal is simultaneously outputted by both decision circuits.

2 Claims, 3 Drawing Figures

FIRE ALARM SYSTEM

BACKGROUND OF THE INVENTION

The present invention relates to fire alarm systems, and more particularly, to a fire alarm system in which the raising of false fire alarms is prevented, but with which a fire alarm can be issued in the early stage of a true fire.

Fire sensors in a conventional fire alarm system are sometimes erroneously operated by electrical noise, tobacco smoke rising momentarily, or a blast of wind. In order to prevent the difficulty of a false fire alarm being issued because of the erroneous operation of the fire sensor, a fire alarm system has been proposed in which, on the side of the fire signal receiver, after a fire sensor is operated, the fire sensor is reset so that a fire alarm is issued only after the fire sensor has operated plural times within a predetermined period of time (see Japanese Published Patent Application No. 36119/1976).

In addition, a fire alarm system has been proposed in which a plurality of fire sensors are installed in a monitoring area, and a fire alarm is issued only when at least two fire sensors are operated (see Japanese Laid-Open Patent Application No. 146594/1977).

As is apparent from the above description, in the conventional fire alarm system in which the issuance of false fire alarms is prevented, there is always a time delay before the alarm can be issued in an actual emergency. That is, the fire alarm system in which a fire alarm is issued in response to signals outputted by at lest two fire sensors is disadvantageous in that the fire alarm can be issued only after the fire has been spread because, in the initial stage of the fire, only one fire sensor is operated. Furthermore, the dual system in which two fire sensors are provided in a monitoring area is intricate in installation, and accordingly high in installation cost.

SUMMARY OF THE INVENTION

Provided according to the invention is a fire alarm system including a fire signal receiver comprising: a plurality of decision means receiving detection signals from fire sensors and performing decision operations for a predetermined period of time to determine whether or not a fire has occurred, thereby to output a fire occurrence signal or a decision signal representing the fact that the decision means has completed a decision operation; and alarm means for issuing a fire alarm when the fire occurrence signal is outputted or at least two decision signals are present.

DESCRIPTION OF THE PREFERRED EMBODIMENTS

Figure 1:
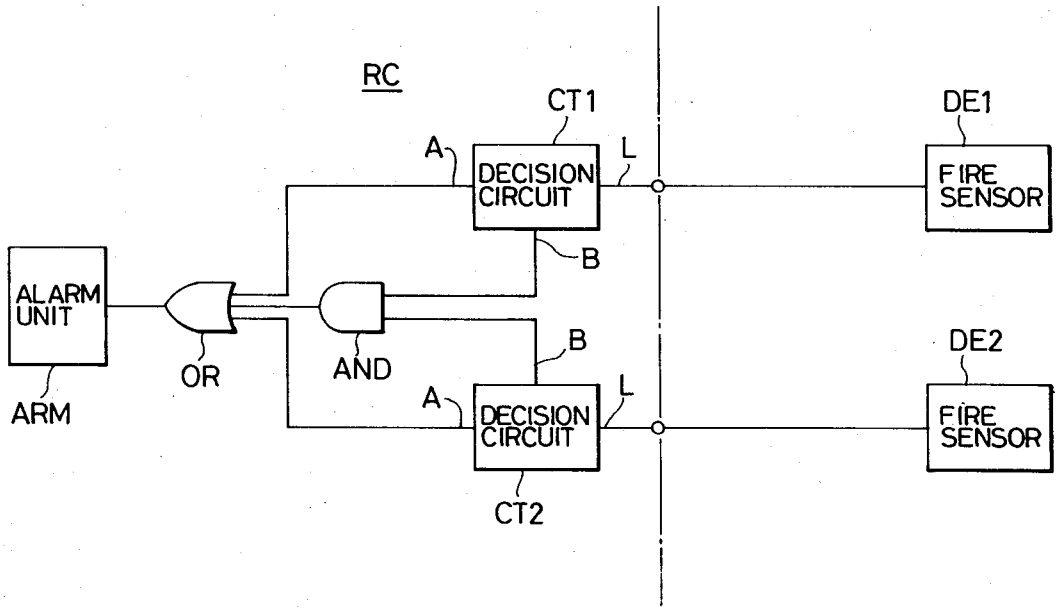
FIG. 1 is a block diagram showing an example of a fire alarm system according to the invention.

A preferred embodiment of a fire alarm system constructed according to the invention will be described with reference to the block diagram shown in FIG. 1.

This embodiment of a fire alarm system of the invention includes a receiver RC, and fire sensors DE1 and DE2 connected to signal lines coupled to the receiver RC and provided in respective monitoring areas. The receiver RC in turn includes decision circuits CT1 and CT2 provided for the respective signal lines, and an alarm device composed of an AND gate, an OR gate, and an alarm unit ARM.

The operation of the fire alarm system thus constructed will be described. When analog data, such as data indicative of the amount of heat or smoke at the scene of a fire, reaches a predetermined value, the fire sensor (DE1 or DE2) applies an operating signal or an analog signal corresponding to the analog data directly (by means of voltage or current) or indirectly (by digital transmission) through the respective signal line to the receiver RC. When the decision circuit CT1 (or CT2) of the receiver RC receives an operating signal or analog signal higher than the predetermined level from the fire sensor DE1 (or DE2), the decision circuit CT1 (or CT2) provides at its terminal B a signal (hereinafter referred to as "decision signal" when applicable) representing the fact that the decision circuit has made a decision operation.

Then, the decision circuit carries out a decision operation for a determined period of time to determine whether or not a fire has occurred.

When the decision circuit determines that a fire has in fact occurred, the decision circuit provides a fire occurrence signal at its terminal A. When the fire occurrence signal is present at the terminal A, the alarm unit is driven through the OR gate to cause a buzzer or a display lamp to issue an alarm for the fire. In the case where both the decision circuits CT1 and CT2 provide decision signals at the terminals B, the two inputs to the AND gate are at the high level, and therefore the output of the AND gate is also raised to the high level. The high level output is applied through the OR gate to the alarm unit ARM to drive the latter. Once the alarm unit ARM is driven once, it continuously operates, even after the drive signal has been eliminated.

As is apparent from the above description, even when only one of the fire sensors DE1 and DE2 outputs a fire detection signal, the respective decision circuit (CT1 or CT2) can output a reliable fire occurrence signal. When both the fire sensors DE1 and DE2, which are located adjacent to each other, provide fire detection signals, the fire alarm is operated immediately.

Figure 2:
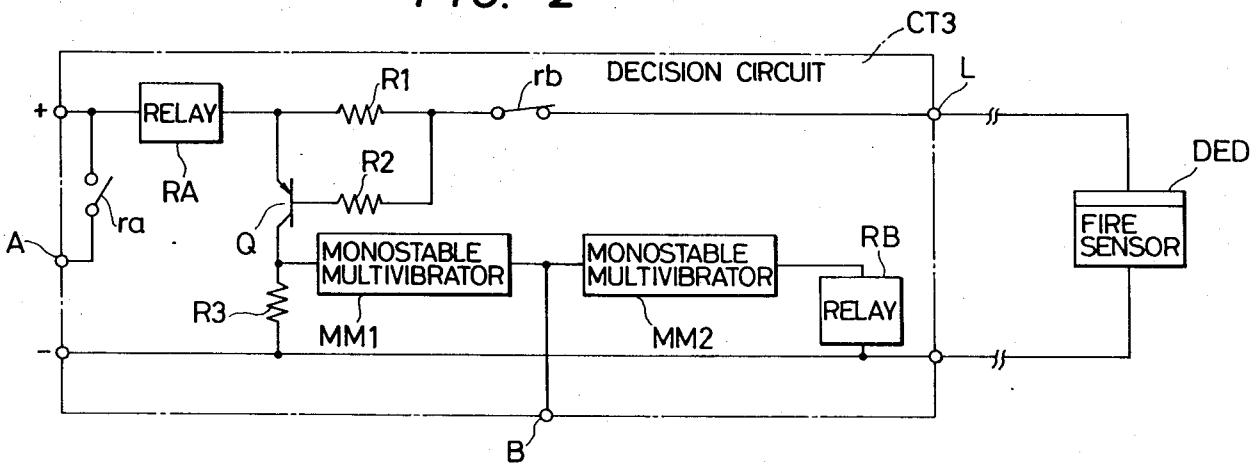
FIG. 2 is a circuit diagram, partly as a block diagram, showing an example of a decision circuit of FIG. 1.
Figure 3:
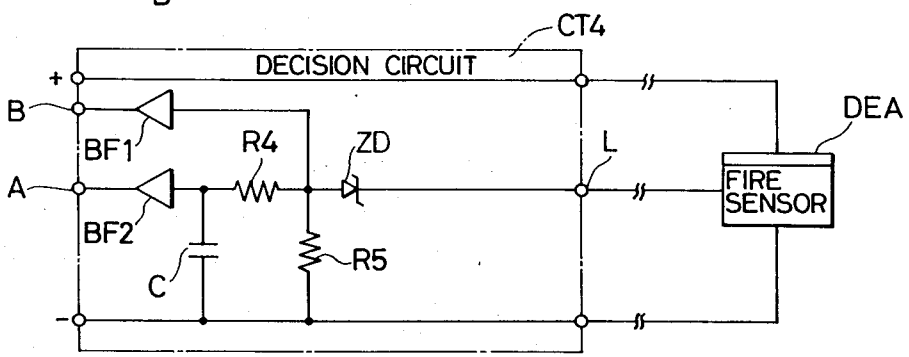
FIG. 3 is a circuit diagram, partly as a block diagram, showing another example of the decision circuit of FIG. 1.

Examples of the fire sensors (DE1 and DE2) and the decision circuits (CT1 and CT2) in a fire alarm system employing on-off type fire sensors and in a first alarm system using analog-type fire sensors will be described with reference to circuit diagrams, partly as block diagrams, of FIGS. 2 and 3.

First, the first alarm system using on-off type fire sensors, which is quite extensively used, will be described with reference to FIG. 2.

An on-off type fire sensor DED is connected between a pair of signal and power lines coupled to a decision circuit CT3. The decision circuit CT3 includes a relay RA having a normally open contact ra, a relay RB having a normally closed contact rb, resistors R1 through R3, a transistor Q, and two monostable multivibrators MM1 and MM2.

When a predetermined temperature or smoke density has been reached, the on-off type fire sensor DED provides a low impedance between the pair of lines to short-circuit the latter, which state is self-held. As a result, current flows in the series circuit of the relay RA, the resistor R1, the normally closed contact rb, and the fire sensor DED, and the transistor Q is rendered conductive (on). Therefore, the monostable multivibrator MM1 is triggered by the collector current of the transistor Q. The monostable multivibrators MM1 and MM2 are triggered and retriggered with the rise of a pulse. When triggered, the monostable multivibrator MM1 outputs a rectangular pulse having a width T1, which triggers the monostable multivibrator MM2. As a result, the monostable multivibrator MM2 outputs a rectangular pulse having a width T2 (T1>T2), which drives the relay RB. Therefore, the normally closed contact rb of the relay RB is opened so that the fire sensor is deenergized, i.e., it is restored.

An operating current flows in the relay RA momentarily, but the latter RA is not operated. On the other hand, the relay RB is driven for a period of time corresponding to the pulse width T2. When the relay RB is later restored, the contact rb is closed so that the fire sensor DED is energized again to monitor the respective area.

If the fire sensor DED is operated again within the period of time T1 after its first operation, the monostable multivibrator MM1 is triggered again; however, since the rectangular pulse is being outputted, the monostable multivibrator MM2 is not triggered, and therefore the fire sensor DED is not restored. Accordingly, the operating current flows continuously in the relay Ra so that the normally open contact ra is closed and a high level voltage signal is outputted at the terminal A. This is the fire occurrence signal.

On the other hand, upon first operation of the fire sensor DED, a high level signal is provided at the terminal of the monostable multivibrator MM1. This is the decision signal mentioned above.

As is apparent from the above description, the decision circuit CT3 outputs the fire occurrence signal when the fire sensor DED operates twice within a predetermined period of time, and the decision circuit CT3 outputs the decision signal when the fire sensor operates initially.

A fire alarm system using an analog-type fire sensor DEA will be described with reference to FIG. 3. The fire sensor DEA is connected through a pair of power lines and a signal line to a decision circuit CT4. the decision circuit CT4 is composed of two buffer circuits BF1 and BF2 having predetermined input threshold values, an integrator circuit including a resistor RF and a capacitor C, a Zener diode ZD for detecting the level of an analog voltage from the fire sensor DEA, and a resistor R5.

The fire sensor DEA outputs an analog signal voltage proportional to analog data such as temperature or smoke density. This voltage is applied to a terminal L of the decision circuit CT4. If the voltage is higher than a predetermined level, the Zener diode develops a detection voltage across the resistor R5. In the cse where the temperature or smoke density is normal, the detection voltage is not outputted. When a fire occurs and the analog signal becomes higher than the predetermined level, the buffer circuit BF1 outputs a high level signal.

This signal is applied, as the decision signal, to the terminal B. If the analog voltage is maintained higher than the predetermined level for a certain period of time, the charge voltage of the capacitor C in the integrator circuit reaches a predetermined value, whereupon the buffer circuit BF2 outputs a high level signal. This signal is applied, as the fire occurrence signal, to the terminal A.

As is apparent from the above description, even if the output of the fire sensor DEA temporarily becomes higher than the predetermined level because of noise, the decision circuit CT4 will not output the fire occurrence signal, although it outputs the decision signal. When a fire occurs, the decision circuit CT4 thus outputs the fire occurrence signal without fail.

In general, in the case where a plurality of fire sensors are installed in a monitored area, the logicl product of the decision signals outputted by the decision circuits of fire sensors which are adjacent, for instance, in the predicted direction of the flow of smoke is obtained, and the fire alarm is operated according to the logical product thus produced. This is to be determined according to the spread of an ordinary fire. On the other hand, if the analog signals outputted by the fire sensors are transmitted to the fire signal receiver through a digital transmission path, and digital signals representing the analog data are inputted sequentially to a microcomputer, the decision can be performed similarly utilizing the addresses of the fire sensors and the digital data representing fire phenomena such as heat and smoke.

As is apparent from the above description, with the fire alarm system of the invention, issuance of a false fire alarm due to noise or the like is prevented, and a reliable fire alarm is always issued. Thus, the fire alarm system of the invention is considerably effective in fire prevention and protection of industry.

I claim:

1. In a fire alarm system comprising a plurality of fire sensors installed in a monitoring area and a fire signal receiver which issues a fire alarm in response to fire detection signals outputted by said fire sensors, the improvement wherein said receiver comprises:

a plurality of decision means receiving said fire detection signals from said fire sensors for producing fire occurrence signals representing a first level of probability that a fire has occurred and decision signals representing a second, lower, level of probability that a fire has occurred; and fire alarm means for issuing a fire alarm when one of said fire occurrence signals is outputted or at least two said decision signals are produced, wherein said fire sensors comprise on-off type fire sensors, and each of said decision means produces a fire occurrence signal when the respective fire sensor has operated plural times within a predetermined period of time.

2. In a fire alarm system comprising a plurality of fire sensors installed in a monitoring area and a fire signal receiver which issues a fire alarm in response to fire detection signals outputted by said fire sensors, the improvement wherein said receiver comprises:

a plurality of decision means receiving said fire detection signals from said fire sensors for producing fire occurrence signals representing a first level of probability that a fire has occurred and decision signals representing a second, lower, level of probability that a fire has occurred; and fire alarm means for issuing a fire alarm when one of said fire occurrence signals is outputted or at least two said decision signals are produced, wherein said fire sensors comprise analog type fire sensors producing analog data, and wherein each of said fire sensors comprises means for integrating analog fire data signals for producing a fire occurrence signal from the integration of said analog data.

* * * * *